US012601124B1

(12) United States Patent
Nagel

(10) Patent No.: US 12,601,124 B1
(45) Date of Patent: Apr. 14, 2026

(54) SYSTEM AND METHOD FOR INDICATING DIFFERENCE IN AMPLITUDE SETTING FOR COMPACTOR

(71) Applicant: Caterpillar Paving Products Inc., Brooklyn Park, MN (US)

(72) Inventor: Brian Nagel, Ramsey, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 18 days.

(21) Appl. No.: 18/944,023

(22) Filed: Nov. 12, 2024

(51) Int. Cl.
*E01C 19/28* (2006.01)

(52) U.S. Cl.
CPC ..... *E01C 19/288* (2013.01)

(58) Field of Classification Search
None
See application file for complete search history.

(56) References Cited

U.S. PATENT DOCUMENTS

| | | | | |
|---|---|---|---|---|
| 5,727,900 | A | 3/1998 | Sandstrom | |
| 2016/0298308 | A1* | 10/2016 | Oetken | E01C 19/288 |
| 2021/0340714 | A1 | 11/2021 | Persson | |
| 2022/0042253 | A1* | 2/2022 | Nagel | E01C 21/00 |

FOREIGN PATENT DOCUMENTS

| | | |
|---|---|---|
| WO | 2015130290 | 9/2015 |
| WO | 2022079643 | 4/2022 |

* cited by examiner

*Primary Examiner* — Anshul Sood
*Assistant Examiner* — Wenyuan Yang

(57) ABSTRACT

A system for a compactor includes one or more first sensors, one or more second sensors, and a controller including one or more memories and one or more processors. The processors are configured to receive, from the first sensors, one or more first signals indicative of a first amplitude of vibration of a first vibration system of the compactor, receive, from the second sensors, one or more second signals indicative of a second amplitude of vibration of a second vibration system of the compactor, determine if a difference between the first amplitude of vibration and the second amplitude of vibration is greater than a predetermined threshold value stored in the memories, and generate an output signal if a difference between the first amplitude of vibration and the second amplitude of vibration is greater than the predetermined threshold value.

7 Claims, 4 Drawing Sheets

SYSTEM AND METHOD FOR INDICATING DIFFERENCE IN AMPLITUDE SETTING FOR COMPACTOR

TECHNICAL FIELD

The present disclosure relates to a compactor, and more particularly, to a system for indicating a difference in amplitude setting for the compactor and a method for indicating the difference in amplitude setting for the compactor.

BACKGROUND

A compactor is used for compacting materials like asphalt, soil, concrete, and/or other materials. The compactor includes a pair of drums that contact the materials to be compacted. Specifically, the pair of drums include a first drum disposed at a front end of the compactor and a second drum disposed at a rear end of the compactor. Each drum is equipped with a vibration system for varying an amplitude and frequency of vibrations of the corresponding drum.

In some cases, the compactor can be set up incorrectly and the drums may operate at different vibrating amplitudes. The different vibrating amplitudes of the first drum and the second drum may cause poor and/or uneven compaction and may also impact a density of compaction. Further, the different vibrating amplitudes of the drums may cause wear of the drums, may damage the drums, and/or may cause damage/wastage of the material. Moreover, the different vibrating amplitudes may increase operator fatigue and discomfort due to uneven vibrations transmitted to the compactor's operator cab.

WO2022079643 describes a vibratory compaction machine that includes a chassis, at least one drum, and a control system. The at least one drum is rotatable about an axis that faces in a Y-axial direction and is mounted to the chassis to allow rotation of the drum over a work surface. The at least one vibration mechanism is configured to generate vibrations that are transmitted as impacts directed in a Z-axial direction by the at least one drum to the work surface. The at least one vibration mechanism is provided with a plurality of different amplitude settings. The control system is configured to measure acceleration forces of the at least one drum in a direction that substantially corresponds to an X-axial direction, wherein the acceleration forces are generated by the vibration mechanism and the X-axial direction extends in a direction that is substantially orthogonal to the Y-axial direction and the Z-axial direction.

SUMMARY OF THE DISCLOSURE

In an aspect of the present disclosure, a system for indicating a difference in amplitude setting for a compactor is provided. The system includes one or more first sensors associated with a first drum of the compactor. The one or more first sensors are configured to generate one or more first signals indicative of a first amplitude of vibration of a first vibration system associated with the first drum. The system also includes one or more second sensors associated with a second drum of the compactor. The one or more second sensors are configured to generate one or more second signals indicative of a second amplitude of vibration of a second vibration system associated with the second drum. The system further includes a controller. The controller includes one or more memories, and one or more processors communicably coupled with each of the one or more memories, the one or more first sensors, and the one or more second sensors. The one or more memories are configured to store a predetermined threshold value for a difference between the first amplitude of vibration and the second amplitude of vibration. The one or more processors are configured to receive, from the one or more first sensors, the one or more first signals indicative of the first amplitude of vibration of the first vibration system. The one or more processors are also configured to receive, from the one or more second sensors, the one or more second signals indicative of the second amplitude of vibration of the second vibration system. The one or more processors are further configured to determine if a difference between the first amplitude of vibration and the second amplitude of vibration is greater than the predetermined threshold value. The one or more processors are configured to generate an output signal if the difference between the first amplitude of vibration and the second amplitude of vibration is greater than the predetermined threshold value. The output signal is indicative of the difference in amplitude setting of the compactor.

In another aspect of the present disclosure, a compactor is provided. The compactor includes a frame. The compactor also includes a first drum coupled to the frame. The compactor further includes a first vibration system disposed within the first drum and adapted to vibrate the first drum. The compactor includes a second drum coupled to the frame. The compactor also includes a second vibration system disposed within the second drum and adapted to vibrate the second drum. The compactor further includes a system for indicating a difference in amplitude setting for the compactor. The system includes one or more first sensors associated with the first drum of the compactor. The one or more first sensors are configured to generate one or more first signals indicative of a first amplitude of vibration of the first vibration system associated with the first drum. The system also includes one or more second sensors associated with the second drum of the compactor. The one or more second sensors are configured to generate one or more second signals indicative of a second amplitude of vibration of the second vibration system associated with the second drum. The system further includes a controller. The controller includes one or more memories, and one or more processors communicably coupled with each of the one or more memories, the one or more first sensors, and the one or more second sensors. The one or more memories are configured to store a predetermined threshold value for a difference between the first amplitude of vibration and the second amplitude of vibration. The one or more processors are configured to receive, from the one or more first sensors, the one or more first signals indicative of the first amplitude of vibration of the first vibration system. The one or more processors are also configured to receive, from the one or more second sensors, the one or more second signals indicative of the second amplitude of vibration of the second vibration system. The one or more processors are further configured to determine if a difference between the first amplitude of vibration and the second amplitude of vibration is greater than the predetermined threshold value. The one or more processors are configured to generate an output signal if the difference between the first amplitude of vibration and the second amplitude of vibration is greater than the predetermined threshold value. The output signal is indicative of the difference in amplitude setting of the compactor.

In yet another aspect of the present disclosure, a method for indicating a difference in amplitude setting for a compactor is provided. The method includes generating, by one or more first sensors associated with a first drum of the compactor, one or more first signals indicative of a first amplitude of vibration of a first vibration system associated with the first drum. The method also includes generating, by one or more second sensors associated with a second drum of the compactor, one or more second signals indicative of a second amplitude of vibration of a second vibration system associated with the second drum. The method further includes receiving, by one or more processors of a controller, the one or more first signals indicative of the first amplitude of vibration of the first vibration system from the one or more first sensors. The method includes receiving, by the one or more processors, the one or more second signals indicative of the second amplitude of vibration of the second vibration system from the one or more second sensors. The method also includes determining, by the one or more processors, if a difference between the first amplitude of vibration and the second amplitude of vibration is greater than a predetermined threshold value for a difference between the first amplitude of vibration and the second amplitude of vibration. Further, one or more memories of the controller are configured to store the predetermined threshold value. The method further includes generating, by the one or more processors, an output signal if the difference between the first amplitude of vibration and the second amplitude of vibration is greater than the predetermined threshold value. The method includes indicating the difference in amplitude setting of the compactor based on the generation of the output signal.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
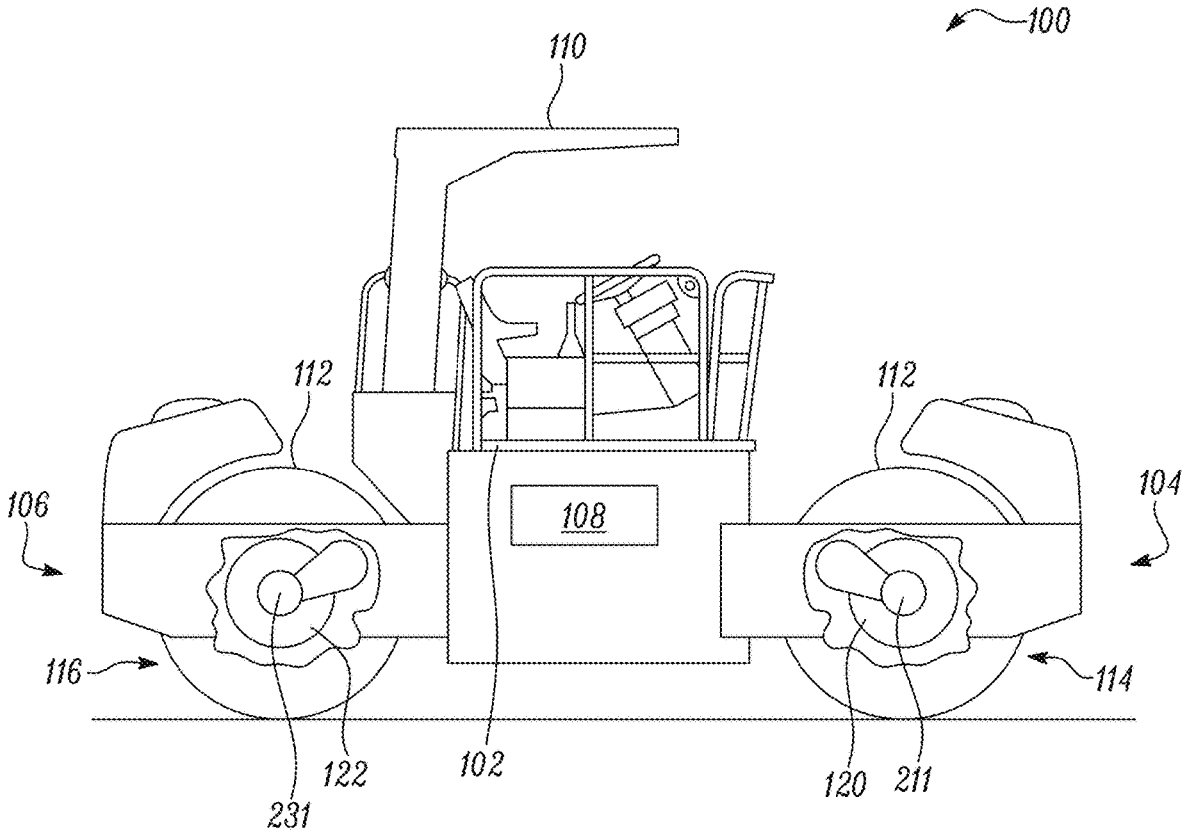
FIG. 1 is a schematic perspective view of a compactor, according to an example of the present disclosure.

Referring to FIG. 1, a schematic perspective view of a compactor 100 is illustrated. The compactor 100 may be a soil compactor, an asphalt compactor, a concrete compactor, a landfill compactor, a pneumatic roller, a tandem vibratory roller, and the like. Further, the disclosure is not limited to a type of the compactor 100 and may include any other machine that includes drums/rollers with vibratory systems or vibratory members for which amplitude of vibrations can be measured.

The compactor 100 includes a frame 102. The frame 102 supports various components of the compactor 100 thereon. The compactor 100 defines a front end 104 and a rear end 106 opposite the front end 104. The compactor 100 may include a power source 108 supported by the frame 102. Various components of the compactor 100 are operated by the power source 108. The power source 108 may be an engine, such as, an internal combustion engine, a fuel cell, a battery system, and the like, without limiting the scope of the present disclosure. The compactor 100 further includes an operator cabin 110. An operator may be seated within the operator cabin 110 to perform and/or observe compaction operations.

The compactor 100 further includes a first drum 114 coupled to the frame 102. The first drum 114 is a front compaction roller disposed at the front end 104 of the compactor 100. The compactor 100 includes a first vibration system 120 disposed within the first drum 114. The first vibration system 120 vibrates the first drum 114. The first vibration system 120 includes a number of components, such as, eccentric weights, an actuator, a shift fork, and the like that cause vibration of the first drum 114 at a desired amplitude of vibration. Further, the first vibration system 120 includes a pump 210 (shown in FIG. 2) and a motor 211. The pump 210 may be a hydraulic pump and the motor 211 may be a hydraulic motor. In some examples, the pump 210 is operatively connected to the motor 211 to operate the motor 211. The motor 211 may in turn operate one or more components of the first vibration system 120 to vibrate the eccentric weights of the first vibration system 120 at the desired amplitude of vibration. The pump 210 defines an input end 212 (shown in FIG. 2) and an output end 218 (shown in FIG. 2). The motor 211 defines an input end 216 (shown in FIG. 2) and an output end 220 (shown in FIG. 2).

The compactor 100 also includes a second drum 116 coupled to the frame 102. The second drum 116 is a rear compaction roller disposed at the rear end 106 of the compactor 100. The first drum 114 and the second drum 116 may be similar to each other in terms of design and functionality. The first drum 114 and the second drum 116 together support the frame 102 of the compactor 100 and to provide mobility to the compactor 100. Further, the first drum 114 and the second drum 116 contact a work surface to perform a compaction operation for compacting materials, such as, asphalt, soil, gravel, and the like. Each of the first drum 114 and the second drum 116 includes an outer shell 112. The outer shell 112 contacts the work surface during the compaction operation or during mobility of the compactor 100.

The compactor 100 further includes a second vibration system 122 disposed within the second drum 116. The second vibration system 122 vibrates the second drum 116. The second vibration system 122 includes a number of components, such as, eccentric weights, an actuator, a shift fork, and the like that cause vibration of the second drum 116 at a desired amplitude of vibration. Further, the second vibration system 122 includes a pump 230 (shown in FIG. 2) and a motor 231. The pump 230 may be a hydraulic pump and the motor 231 may be a hydraulic motor. In some examples, the pump 230 is operatively connected to the motor 231 to operate the motor 231. The motor 231 may in turn operate one or more components of the second vibration system 122 to vibrate the eccentric weights of the second vibration system 122 at the desired amplitude of vibration. The pump 230 defines an input end 232 (shown in FIG. 2) and an output end 238 (shown in FIG. 2). The motor 231 defines an input end 236 (shown in FIG. 2) and an output end 240 (shown in FIG. 2).

Figure 2:
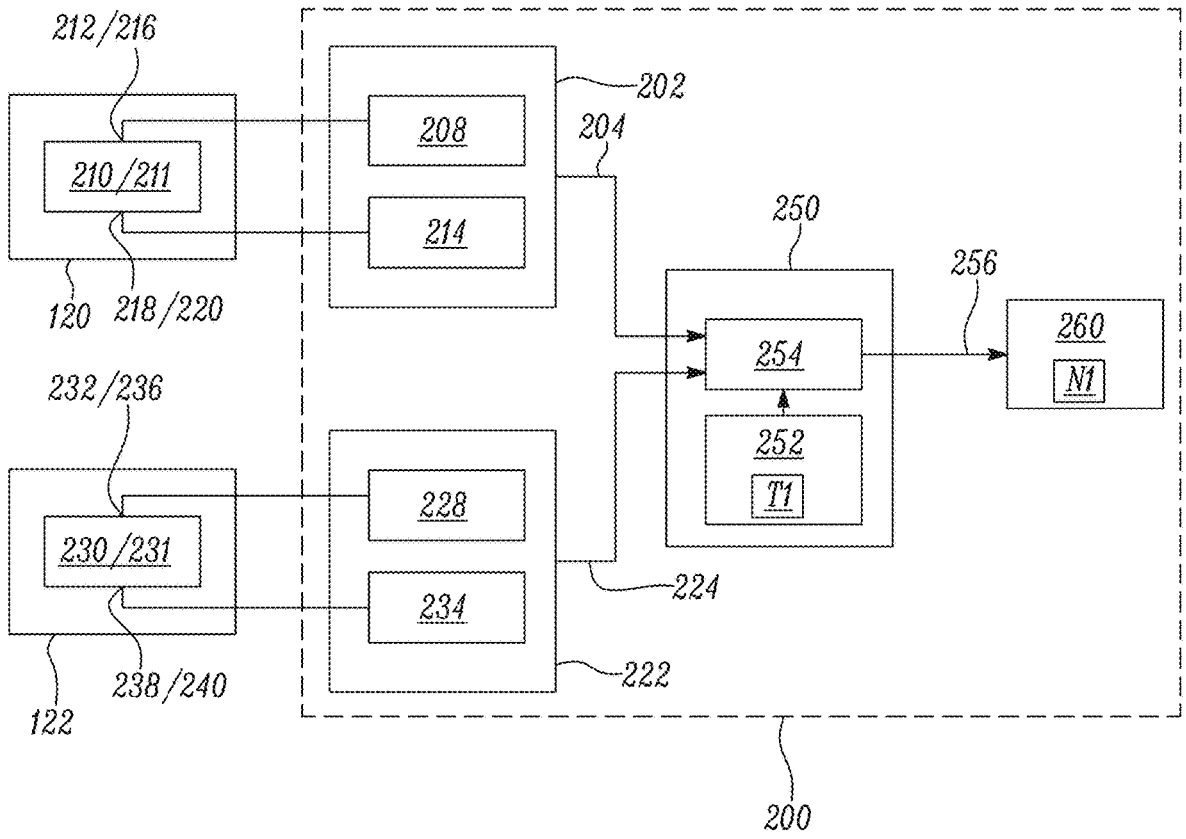
FIG. 2 is a schematic block diagram of a system for indicating a difference in amplitude setting for the compactor of FIG. 1, according to an example of the present disclosure.

Referring to FIG. 2, a schematic block diagram of a system 200 for indicating a difference in amplitude setting for the compactor 100 of FIG. 1 is illustrated, according to an example of the present disclosure. The compactor 100 includes the system 200 for indicating the difference in amplitude setting for the compactor 100. Specifically, the system 200 indicates a difference between a first amplitude of vibration of the first vibration system 120 and a second amplitude of vibration of the second vibration system 122.

The system 200 includes one or more first sensors 202 associated with the first drum 114 (see FIG. 1) of the compactor 100. The one or more first sensors 202 generate one or more first signals 204 indicative of the first amplitude of vibration of the first vibration system 120 associated with the first drum 114. The one or more first sensors 202 are pressure sensors. Specifically, the one or more first sensors 202 include a first input pressure sensor 208 and a first output pressure sensor 214. The first input pressure sensor 208 may be disposed at the input end 212, 216 of the pump 210 or the motor 211 of the first vibration system 120. Further, the first output pressure sensor 214 may be disposed at the output end 218, 220 of the pump 210 or the motor 211 of the first vibration system 120. In one example, the system 200 may include a single first sensor 202 that may be disposed at the input end 212, 216 of the pump 210 or the motor 211 of the first vibration system 120. In another example, the system 200 may include a single first sensor 202 that may be disposed at the output end 218, 220 of the pump 210 or the motor 211 of the first vibration system 120. The present disclosure is not limited to a type or a number of first sensors 202 associated with the system 200.

The system 200 also includes one or more second sensors 222 associated with the second drum 116 (see FIG. 1) of the compactor 100. The one or more second sensors 222 generate one or more second signals 224 indicative of a second amplitude of vibration of the second vibration system 122 associated with the second drum 116. The one or more first sensors 202 are pressure sensors. Specifically, the one or more second sensors 222 include a second input pressure sensor 228 and a second output pressure sensor 234. The second input pressure sensor 228 may be disposed at the input end 232, 236 of the pump 230 or the motor 231 of the second vibration system 122. Further, the second output pressure sensor 234 may be disposed at the output end 238, 240 of the pump 230 or the motor 231 of the second vibration system 122. In one example, the system 200 may include a single second sensor 222 that may be disposed at the input end 232, 236 of the pump 230 or the motor 231 of the second vibration system 122. In another example, the system 200 may include a single second sensor 222 that may be disposed at the output end 238, 240 of the pump 230 or the motor 231 of the second vibration system 122. The present disclosure is not limited to a type or the number of second sensors 222 associated with the system 200. It should be noted that the first and second sensors 202, 222 may include any type of sensor that provides information regarding the first and second amplitude of vibrations, respectively.

The system 200 further includes a controller 250. The controller 250 includes one or more memories 252. The one or more memories 252 store a predetermined threshold value T1 for a difference between the first amplitude of vibration and the second amplitude of vibration. In some examples, the predetermined threshold value T1 for the difference between the first amplitude of vibration and the second amplitude of vibration may be variable based on a direction of travel of the compactor 100, a vibration speed of the first vibration system 120, a vibration speed of the second vibration system 122, a temperature of hydraulic oil, and/or a temperature of material being compacted by the compactor 100. The predetermined threshold value T1 may vary based on other factors not mentioned herein, without limiting the scope of the present disclosure.

The one or more memories 252 may include any means of storing information, including a hard disk, an optical disk, a floppy disk, ROM (read only memory), RAM (random access memory), PROM (programmable ROM), EEPROM (electrically erasable PROM), or other computer-readable memory media.

The controller 250 also includes one or more processors 254. The one or more processors 254 are communicably coupled with each of the one or more memories 252, the one or more first sensors 202, and the one or more second sensors 222.

It should be noted that the one or more processors 254 may embody a single microprocessor or multiple microprocessors for receiving various input signals and generating output signals. Numerous commercially available microprocessors may perform the functions of the one or more processors 254. The one or more processors 254 may further include a general processor, a central processing unit, an application specific integrated circuit (ASIC), a digital signal processor, a field programmable gate array (FPGA), a digital circuit, an analog circuit, a microcontroller, any other type of processor, or any combination thereof. The one or more processors 254 may include one or more components that may be operable to execute computer executable instructions or computer code that may be stored and retrieved from the one or more memories 252.

The one or more processors 254 receive, from the one or more first sensors 202, the one or more first signals 204 indicative of the first amplitude of vibration of the first vibration system 120. The one or more processors 254 further receive, from the one or more second sensors 222, the one or more second signals 224 indicative of the second amplitude of vibration of the second vibration system 122.

The one or more processors 254 determine if the difference between the first amplitude of vibration and the second amplitude of vibration is greater than the predetermined threshold value T1. Specifically, the one or more processors 254 retrieve the predetermined threshold value T1 from the one or more memories 252 to determine if the difference between the first amplitude of vibration and the second amplitude of vibration is greater than the predetermined threshold value T1. The one or more processors 254 further generate an output signal 256 if the difference between the first amplitude of vibration and the second amplitude of vibration is greater than the predetermined threshold value T1. The output signal 256 is indicative of the difference in amplitude setting of the compactor 100.

The system 200 further includes an output module 260 communicably coupled with the one or more processors 254. The output module 260 receives the output signal 256 from the one or more processors 254. The output module 260 generates a notification N1 to indicate the difference in amplitude setting to a user. The user may be an operator or any personnel in-charge of the compactor 100. In some examples, the output module 260 may be a display screen, a speaker, a smartphone, a tablet, a light, and the like. The output module 260 may be disposed inside the operator cabin 110. Alternatively, the output module 260 may be disposed outside the operator cabin 110, so that the user present outside the compactor 100 may be notified of the difference in amplitude setting. The notification N1 may be an audio message, a text message, a video message, or a combination thereof. In some examples, the output module 260 may trigger an alarm or a light signal to indicate the difference in amplitude setting to the user, without limiting the scope of the present disclosure.

Figure 3:
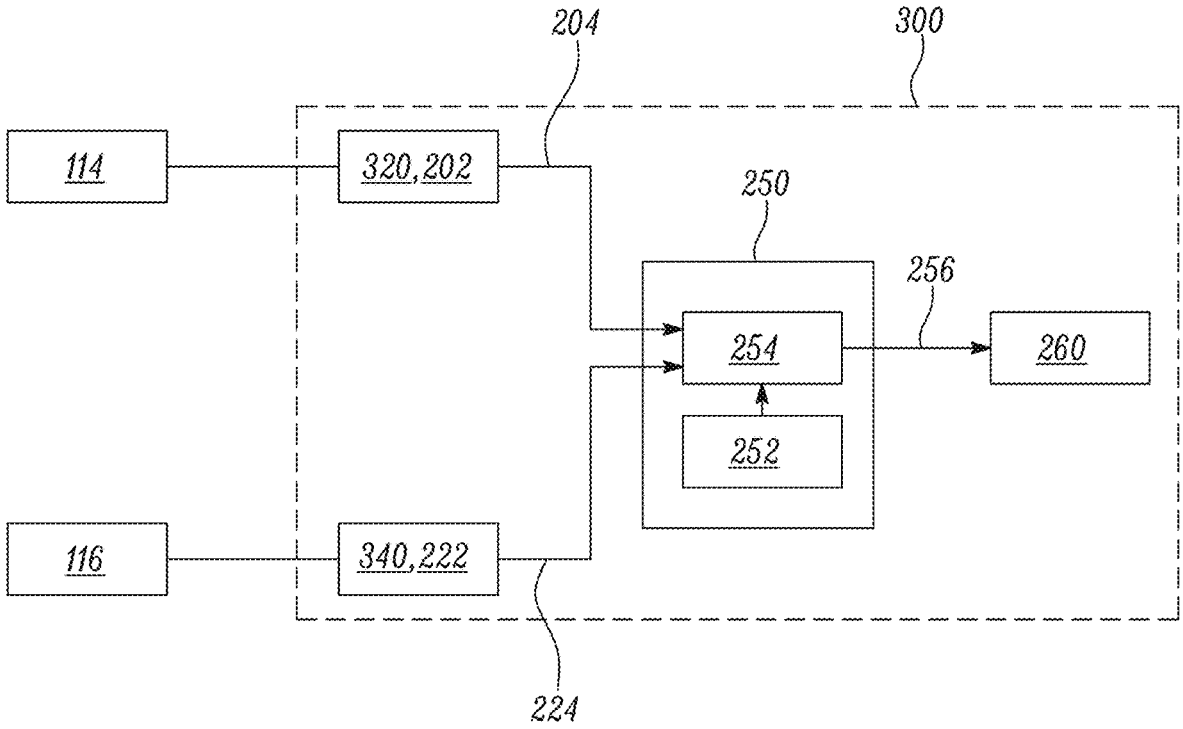
FIG. 3 is a schematic block diagram of a system for indicating the difference in amplitude setting for the compactor of FIG. 1, according to another example of the present disclosure.

Referring to FIG. 3, a schematic block diagram of a system 300 for indicating the difference in amplitude setting for the compactor 100 of FIG. 1 is illustrated, according to another example of the present disclosure. The system 300 is substantially similar to the system 200 illustrated in FIG. 2, with common components being referred to by the same numerals. However, the one or more first sensors 202 of the system 300 includes a first accelerometer 320. In some examples, the one or more first sensors 202 include a single first accelerometer 320. The first accelerometer 320 measures an acceleration force of the first drum 114. The first accelerometer 320 may be mounted at a vibratory side of isolation mounts (not shown) of the first drum 114. Further, the one or more second sensors 222 include a second accelerometer 340. In some examples, the one or more second sensors 222 include a single second accelerometer 340. The second accelerometer 340 measures an acceleration force of the second drum 116. The second accelerometer 340 may be mounted at a vibratory side of isolation mounts (not shown) of the second drum 116.

In an example, each of the first accelerometer 320 and the second accelerometer 340 may convert mechanical vibrations of the first drum 114 and second drum 116 into an electrical signal to determine the difference in amplitude setting for the compactor 100. The first accelerometer 320 and the second accelerometer 340 generate the first signal 204 and the second signal 224, respectively, and transmit the first signal 204 and the second signal 224 to the processors 254, based on which the processors 254 determine the difference in amplitude setting of the compactor 100 in a manner explained in relation to FIG. 2.

It is to be understood that individual features shown or described for one embodiment may be combined with individual features shown or described for another embodiment. The above-described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure relates to the compactor 100. The compactor 100 includes the first drum 114 and the second drum 116 coupled to the frame 102. The compactor 100 also includes the first vibration system 120 and the second vibration system 122 disposed within the first drum 114 and the second drum 116, respectively.

The compactor 100 further includes the system 200, 300. The system 200, 300 includes the controller 250. The controller 250 includes the one or more processors 254 that generates the output signal 256 if the difference between the first amplitude of vibration and the second amplitude of vibration is greater than the predetermined threshold value T1. The notification N1 may alert the user regarding the difference in amplitude setting of the first and second drums 114, 116. Accordingly, the user may adjust the amplitude setting of the first drum 114 or the second drum 116.

Further, the system 200, 300 may prevent an uneven compaction, for example over-compaction or under-compaction, of materials, and may also prevent damage/wastage of material by preventing an operation of the first and second drums 114, 116 at different amplitudes, based on the notification N1 provided to the user. Furthermore, the system 200, 300 may prevent wear/damage to the compactor 100 due to uneven vibrations generated by the first and second drums 114, 116. Moreover, the system 200, 300 may reduce operator fatigue and discomfort that may be otherwise caused due to the uneven vibrations transmitted to the operator cabin 110 of the compactor 100 if the first amplitude of vibration is different from the second amplitude of vibration.

Overall, the system 200, 300 is simple in construction and does not require complex components for operation. Further, the system 200, 300 may improve operating time and an efficiency of the compactor 100. Furthermore, the system 200, 300 may be cost-effective, may be retrofitted on existing compactors, and may be easy to install on compactors.

Figure 4:
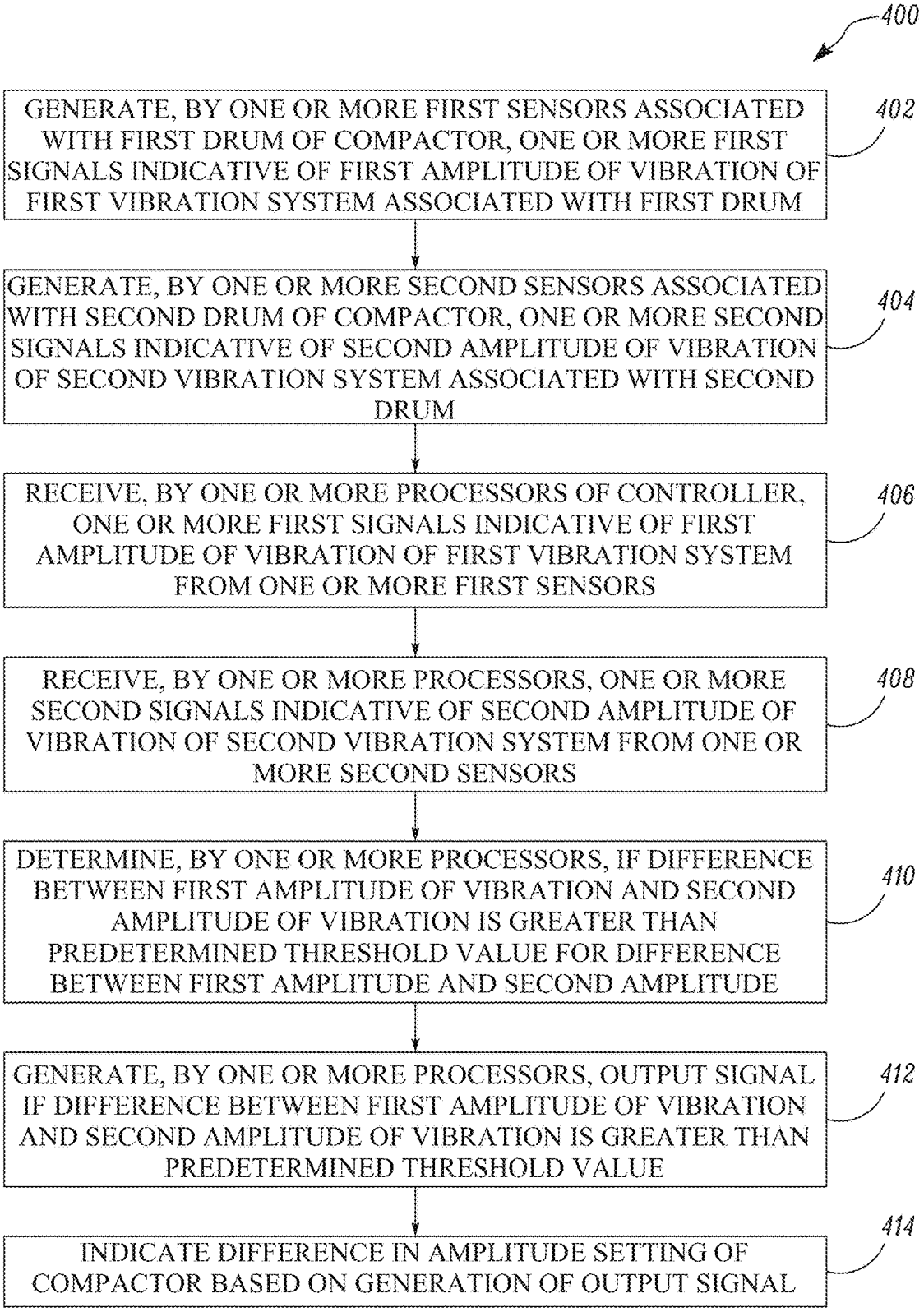
FIG. 4 is a flowchart of a method for indicating the difference in amplitude setting for the compactor of FIG. 1, according to an example of the present disclosure.

FIG. 4 is a flowchart for a method 400 for indicating the difference in amplitude setting for the compactor 100. With reference to FIGS. 1 to 4, at step 402, the one or more first sensors 202 associated with the first drum 114 of the compactor 100 generate the one or more first signals 204 indicative of the first amplitude of vibration of the first vibration system 120 associated with the first drum 114.

At step 404, the one or more second sensors 222 associated with the second drum 116 of the compactor 100 generate the one or more second signals 224 indicative of the second amplitude of vibration of the second vibration system 122 associated with the second drum 116.

At step 406, the one or more processors 254 of the controller 250 receive the one or more first signals 204 indicative of the first amplitude of vibration of the first vibration system 120 from the one or more first sensors 202.

At step 408, the one or more processors 254 receive the one or more second signals 224 indicative of the second amplitude of vibration of the second vibration system 122 from the one or more second sensors 222.

At step 410, the one or more processors 254 determines if the difference between the first amplitude of vibration and the second amplitude of vibration is greater than the predetermined threshold value T1 for the difference between the first amplitude of vibration and the second amplitude of vibration. The one or more memories 252 of the controller 250 store the predetermined threshold value T1.

At step 412, the one or more processors 254 generate the output signal 256 if the difference between the first amplitude of vibration and the second amplitude of vibration is greater than the predetermined threshold value T1.

At step 414, the difference in amplitude setting of the compactor 100 is indicated based on the generation of the output signal 256.

The output module 260 is communicably coupled with the one or more processors 254. The method 400 further includes a step (not shown) at which the output signal 256 from the one or more processors 254 is received by the output module 260. The method 400 further includes a step (not shown) at which the output module 260 generates the notification N1 to indicate the difference in amplitude setting to the user.

With reference to FIGS. 1, 2, and 4, the one or more first sensors 202 are pressure sensors. The one or more first sensors 202 include the first input pressure sensor 208 and the first output pressure sensor 214. The method 400 further includes a step (not shown) at which the first input pressure sensor 208 is coupled at the input end 212, 216 of the pump 210 or the motor 211 of the first vibration system 120. The method 400 further includes a step (not shown) at which the first output pressure sensor 214 is coupled at the output end 218, 220 of the pump 210 or the motor 211 of the first vibration system 120.

Further, the one or more second sensors 222 are pressure sensors. The one or more second sensors 222 include the first input pressure sensor 208 and the first output pressure sensor 214. The method 400 further includes a step (not shown) at which the second input pressure sensor 228 is coupled at the input end 232, 236 of the pump 230 or the motor 231 of the second vibration system 122. The method 400 further includes a step (not shown) at which the second output pressure sensor 234 is coupled at the output end 238, 240 of the pump 230 or the motor 231 of the second vibration system 122.

With reference to FIGS. 1, 3, and 4, the one or more first sensors 202 include the first accelerometer 320 to measure the acceleration force of the first drum 114. The method 400 further includes a step (not shown) at which the first accelerometer 320 is coupled to the first drum 114.

The one or more second sensors 222 include the second accelerometer 340 to measure the acceleration force of the second drum 116. The method 400 further includes a step (not shown) at which the second accelerometer 340 is coupled to the second drum 116.

It should be noted that the steps 402, 404, 406, 408, 410, 412, 414 of the method 400 may be performed in a sequence that is different from that explained in relation to FIG. 4. Further, various steps 402, 404, 406, 408, 410, 412, 414 can be performed together.

While aspects of the present disclosure have been particularly shown and described with reference to the embodiments above, it will be understood by those skilled in the art that various additional embodiments may be contemplated by the modification of the disclosed work machine, systems, and methods without departing from the spirit and scope of the disclosure. Such embodiments should be understood to fall within the scope of the present disclosure as determined based upon the claims and any equivalents thereof.

What is claimed is:

1. A compactor comprising:

a frame;

a first drum coupled to the frame;

a first vibration system disposed within the first drum and adapted to vibrate the first drum; a second drum coupled to the frame;

a second vibration system disposed within the second drum and adapted to vibrate the second drum; and a system for indicating a difference in amplitude setting for the compactor, wherein the system includes:

one or more first sensors associated with the first drum of the compactor, wherein the one or more first sensors are configured to generate one or more first signals indicative of a first amplitude of vibration of the first vibration system associated with the first drum;

one or more second sensors associated with the second drum of the compactor, wherein the one or more second sensors are configured to generate one or more second signals indicative of a second amplitude of vibration of the second vibration system associated with the second drum; and a controller including one or more memories and one or more processors communicably coupled with each of the one or more memories, the one or more first sensors, and the one or more second sensors, wherein the one or more memories are configured to store a predetermined threshold value for a difference between the first amplitude of vibration and the second amplitude of vibration, the one or more processors being configured to:

receive, from the one or more first sensors, the one or more first signals indicative of the first amplitude of vibration of the first vibration system;

receive, from the one or more second sensors, the one or more second signals indicative of the second amplitude of vibration of the second vibration system;

determine if a difference between the first amplitude of vibration and the second amplitude of vibration is greater than the predetermined threshold value; and generate an output signal if the difference between the first amplitude of vibration and the second amplitude of vibration is greater than the predetermined threshold value, wherein the output signal is indicative of the difference in amplitude setting of the compactor.

2. The compactor of claim 1, wherein each of the one or more first sensors and the one or more second sensors is a pressure sensor.

3. The compactor of claim 2, wherein the one or more first sensors include a first input pressure sensor and a first output pressure sensor, wherein the first input pressure sensor is disposed at an input end of a pump or a motor of the first vibration system, and wherein the first output pressure sensor is disposed at an output end of the pump or the motor of the first vibration system.

4. The compactor of claim 2, wherein the one or more second sensors include a second input pressure sensor and a second output pressure sensor, wherein the second input pressure sensor is disposed at an input end of a pump or a motor of the second vibration system, and wherein the second output pressure sensor is disposed at an output end of the pump or the motor of the second vibration system.

5. The compactor of claim 1, wherein the one or more first sensors include a first accelerometer configured to measure an acceleration force of the first drum, and wherein the one or more second sensors include a second accelerometer configured to measure an acceleration force of the second drum.

6. The compactor of claim 1, wherein the predetermined threshold value for the difference between the first amplitude of vibration and the second amplitude of vibration is variable based on a direction of travel of the compactor, a vibration speed of the first vibration system, a vibration speed of the second vibration system, a temperature of hydraulic oil, and/or a temperature of material being compacted by the compactor.

7. The compactor of claim 1, wherein the system further includes an output module communicably coupled with the one or more processors, wherein the output module is configured to receive the output signal from the one or more processors, and wherein the output module is configured to generate a notification to indicate the difference in amplitude setting to a user.

* * * * *